US005436051A

United States Patent [19]

Donaruma et al.

[11] Patent Number: 5,436,051

[45] Date of Patent: Jul. 25, 1995

[54] HOOK AND LOOP FASTENERS AND METHOD OF MAKING SAME

[75] Inventors: L. Guy Donaruma, Nashua; Lawrence E. Lacombe, Allenstown; Gerald F. Rocha, Bedford, all of N.H.

[73] Assignee: Velcro Industries, B.V., Amsterdam, Netherlands

[21] Appl. No.: 97,436

[22] Filed: Jul. 26, 1993

[51] Int. Cl.[6] ..... B32B 3/06

[52] U.S. Cl. ..... 428/95; 428/96; 428/97; 428/100; 24/448

[58] Field of Search ..... 428/100, 95–97; 24/442, 445, 448

[56] References Cited

U.S. PATENT DOCUMENTS

| | | | |
|---|---|---|---|
| 2,423,555 | 7/1947 | Ender | 117/111 |
| 3,708,382 | 1/1973 | Erb | 428/100 |
| 4,361,925 | 12/1982 | Yamamoto et al. | 428/100 |
| 4,761,318 | 8/1988 | Ott et al. | 428/100 |
| 4,770,917 | 9/1988 | Tochacek et al. | 428/100 |
| 4,910,062 | 3/1990 | Zinke et al. | 428/100 |

FOREIGN PATENT DOCUMENTS

| | | |
|---|---|---|
| 0331215 | 6/1989 | European Pat. Off. . |
| 0350240 | 10/1990 | European Pat. Off. . |

OTHER PUBLICATIONS

Guise et al., "Structural Studies of Shrink-resist Polymers for Wool: Polyisocyantes with Different Backbones", JSDC, Jan. 1976, pp. 17–21.

Abstracts, American Chemical Society, Dec. 1991 (Teltech, Inc.).

*Primary Examiner*—Alexander S. Thomas

*Attorney, Agent, or Firm*—Fish & Richardson

[57] ABSTRACT

A hook or loop component of a hook and loop fastener having a textile ground sheet and filamentary pile, the ground sheet penetrated by a resinous binder of improved properties. Hydrolytically stable cross-linked bonds are formed in a binder under ambient or laundering conditions. Bonds of urea-, ureido-, or urethane-type result from curing of the hook or loop groundsheet by exposure to water molecules, polyfunctional amines, or polyfunctional alcohols. The resin is applied as a hot-melt, as a neat liquid, or as a solute in a solvent. In a method for applying the resin as a hot-melt, a continuous strip of hook or loop elements is heated to approximately the same temperature as the melted resin and the melted resin is applied, using a coating head and coating knife, to a section of tape suspended between two support points. Other cross-link systems and thermoplastic systems are disclosed.

21 Claims, 6 Drawing Sheets

HOOK AND LOOP FASTENERS AND METHOD OF MAKING SAME

BACKGROUND OF THE INVENTION

The invention relates to hook and loop fasteners and their method of manufacture.

Hook and loop fasteners comprise mating strips or patches of filamentary stress-bearing hooks and loops. The hooks are woven, and the loops are knit or woven, into a textile backing, or ground. In order to secure the hook or loop elements to the ground, and to bond the fibers composing the ground to each other, in a manner to withstand the forces involved, the ground is impregnated with a resinous binder to form a composite structure.

The binder matrix adds strength and durability to the fastener. Depending upon the quality of the binder, the hooks and loops may pull out of the ground, and the ground may start to fray, after a number of cycles of closing and opening the fastener. Thus, the binder is an important element in the system.

The material used for the binder greatly affects the fastener's performance. It is desirable that the material be able to withstand numerous cycles of opening and closing, and not break down appreciably under laundering or dry cleaning conditions.

In addition to the particular material used for the binder, the manner in which the binder is applied can affect the fastener's performance. For optimal strength, the binder should impregnate the ground as fully as possible. At the same time, it should not be allowed to wick into the hooks or loops, as that interferes with their ability to engage each other and reduces the effectiveness of the fastener.

The manner in which a binder is applied also affects the cost to produce the fastener. Current fasteners often use binders which are applied to the ground as a solution or as a dispersion. These binders require additional chemicals to effect their cure (cross-linking), and ovens to dry them and promote their cure; the production line can be quite long as a result. The chemicals used to cure the binder, e.g., formaldehyde or aziridines, are often environmentally undesirable, if not toxic. Thus, high energy and capital costs, extensive factory manpower and floorspace, and environmental undesirability are often associated with the binders currently used in hook and loop fastener systems.

An object of the present invention is to provide hook and loop fasteners with improved qualities related to binder performance and another object is to provide improved methods and systems for manufacturing hook and loop fasteners in respect of the binders employed.

SUMMARY OF THE INVENTION

This invention features hook and loop fasteners fabricated with various binders which improve the strength and durability of the fastener. In a first general aspect, a hook or loop component of a hook and loop fastener has a ground sheet and a pile of hook or loop elements extending from the ground sheet, and a solidified hot-melt binder of synthetic resin impregnating the ground sheet.

In various embodiments, fasteners with hot-melt binders possess one or more of the following features. Such fasteners are hydrolytically stable, i.e., they hold up well under repeated laundering. Hot-melt binders which can used successfully in hook and loop fasteners contain the reaction product of free isocyanate groups which have entered into cross-linked bonds to effect cure of the binder. When moisture activates the cross-linking, the bonds are polyurethane-type bonds. Alternatively, exposing the resin to bifunctional or polyfunctional amine or alcohol yields ureido or urethane cross-link bonds, respectively. Hook and loop fasteners in which the binder is photo-cured, or in which cure is the result of free radical catalysis, are also disclosed.

In other embodiments, hook and loop fasteners are fabricated with hot-melt, thermoplastic binders. Such thermoplastics include polyesters and polyamides. Binders which are composed of interpenetrating polymer networks may by used as well.

Hot-melt manufacturing processes are controlled to provide a hook and loop fastener in which the hot-melt binder substantially completely impregnates the ground sheet, but does not contaminate the pile. Hook and loop fasteners with hot-melt binders are manufactured by a process which includes preheating the ground, then applying a fluid mass of binder with a coater.

In another general aspect, the invention features a hook or loop component of a hook and loop fastener which has a ground sheet and a pile of hook or loop elements extending from the ground sheet, and a binder which includes the reaction product of free isocyanate groups which have entered into cross-linked bonds to effect cure of the binder.

Such fasteners result from applying binder to the ground as a neat liquid, or as a solution of binder dissolved in a solvent. The fastener may be the result of curing the binder with moisture, which is either ambient or added to the binder, which reacts with the free isocyanate groups. Alternatively, the fastener is the result of adding polyfunctional amine or alcohol to the binder, and applying the binder to the ground as a hot-melt or as a solution.

In another general aspect, the invention features a method of producing components of hook and loop fasteners in which a ground sheet having a pile of hooks or loops is heated and, in the heated condition, hot-melt adhesive is applied to the ground sheet under conditions enabling penetration of the thickness of the ground sheet without contamination of the pile, and thereafter cooling the component. The hot-melt adhesive contains a cross-linkable component, e.g., free isocyanate groups, and cure results in cross-linked bonds, e.g., urea-type bonds. Alternatively, the adhesive is a thermoplastic.

Conditions which enable proper penetration include heating the ground sheet to a temperature approximately equal to that of the hot-melt adhesive; applying the adhesive with a slot die and spreading it with a coating knife which urges it into the interstices of the ground sheet; applying the adhesive at a location on the ground sheet which is suspended between two support points, and pressing the knife against the ground sheet so as to bend it around the knife edge in V-shaped fashion.

Cooling occurs in an accumulator as the ground sheet passes over successive rollers which are disposed such that the pile side engages the rollers. Cure accelerating agents may be introduced to the adhesive, such as while the ground sheet is still cooling in the accumulator.

DESCRIPTION OF PREFERRED EMBODIMENTS

Figure 1:
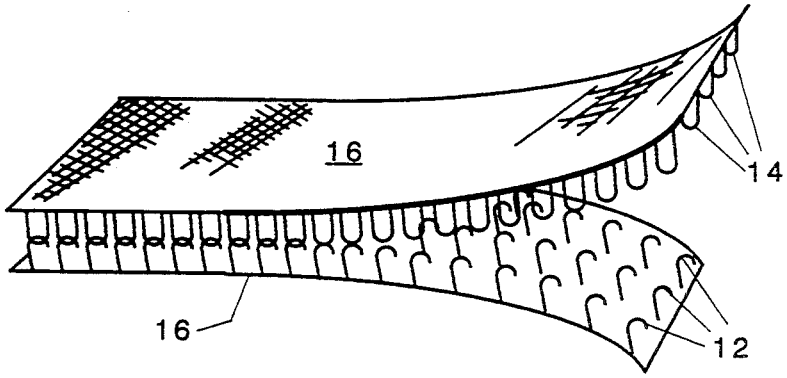
FIG. 1 is a perspective view of a hook and loop fastener, partially peeled apart, showing mating strips of hook elements and loop elements.
Figure 2:
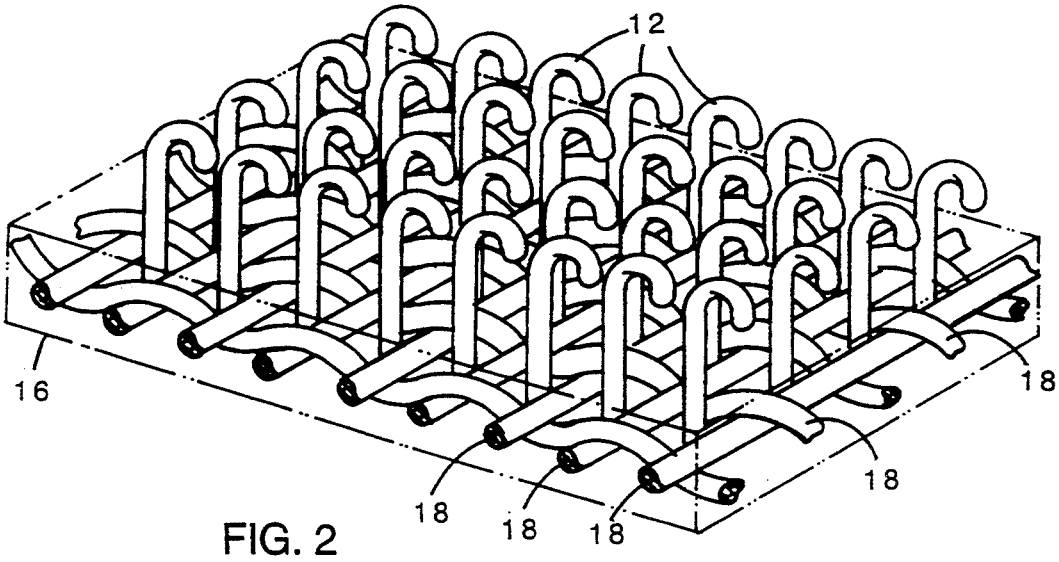
FIG. 2 is a perspective view, highly magnified, of a strip of hook elements, showing the hooks interwoven in a textile ground.

As noted above, hook and loop fasteners comprise mating strips or patches of filamentary stress-bearing hooks 12 and loops 14, as shown in FIG. 1. As shown in FIG. 2, the hooks 12 are woven into a textile backing, or ground, 16. Similarly, the loops 14 are knit or woven into a ground 16. In order to secure the hooks 12 and loops 14, generically referred to as pile elements, to the ground 16 and to bond the fibers 18 composing the ground to each other, in a manner to withstand the forces involved, the ground is impregnated with a resinous binder, suggested by the stippling 19, to form a composite structure.

In preferred embodiments of the invention, the resin binder of a hook or loop fastener is characterized in that, as it cures, it forms cross-linked bonds which are hydrolytically stable, i.e., bonds which are resistant to degradation as the fastener is washed, and stable with respect to dry-cleaning as well. In particular, the most preferred binder is a moisture-curable polyurethane. At the time of its application to the ground, the polyurethane has free isocyanate groups which react in the presence of moisture to form a thermoset resin having urea or urea-like bonds.

Commercially available moisture-curable polyurethanes include Fuller NP-2015, available from the H. B. Fuller Company, 1200 Wolters Blvd., Vadnais Heights, Minn., 55110; Findley adhesive 3082, available from Findley Adhesives, Inc., 11320 Watertown Plank Rd., Wauwatosa Wis., 53226-3413; and Bostik adhesive 10538-63, available from Bostik, Boston St., Middleton, Mass., 01949. These binders are available in solid form and are applied using a hot-melt method—the solid form is melted and applied to the ground —which is described below as the preferred method of application. Because they are applied using a hot-melt method, these binders are referred to as "hot-melt binders."

Silyl-terminated polymers may also be used as the moisture-curable hot-melt composition. Such polymers have terminal groups of the general formula $SIX_{3-n}$, where X is a hydroxyl group, a $C_1$–$C_8$ alkoxy group, a $C_1$–$C_8$ acetoxy group, a $C_1$–$C_8$ alkylamino group, a $C_1$–$C_8$ allylamino group, or a $C_1$–$C_8$ oxime group, and n is 0, 1, or 2. As in the case of isocyanate terminal groups, the silyl groups react in the presence of moisture to effect cure.

Another example of a suitable moisture-curable hot-melt composition includes compositions containing a polymer having urethanesilylurea terminal groups of the general formula $$-O-\overset{O}{\overset{\|}{C}}-NH-R^1-NH-\overset{O}{\overset{\|}{C}}-\underset{H}{N}-(CH_2)_y-Si(OR^2)_{3-p'}$$

and another composition contains a polymer which contains urethane and thiaurethane groups of the general formula:

$$-O-\overset{O}{\overset{\|}{C}}-NH-R^1-NH-\overset{O}{\overset{\|}{C}}-S-(CH_2)_y-Si(OR^2)_{3-p'}$$

each case in which $R^1$ is derived from a monomeric or polymeric diisocyanate; $R^2$ is a $C_{1-4}$ alkyl or alkoxy residue; $R^3$ is a $C_{1-4}$ alkyl residue; $R^4$ is H, a $C_{1-4}$ alkyl group, a phenyl group, or a group having the formula $(CH_2)Si(R^3)_p(OR^2)_{3-p}$, y is an integer from 1–4, and p is 0, 1, or 2.

Hot-melt, moisture-curable binders provide the advantages noted above. They form hydrolytically stable, dry-clean resistant, cross-linked bonds which give the hook and loop fastener excellent strength and durability without the need for environmentally undesirable curing agents or ovens; the production line is resultantly shorter and requires less manpower to operate; and savings are realized in terms of materials cost, energy cost, manpower cost, and floorspace. Of the hot-melt, moisture-curable binders available, moisture-curable polyurethane is most preferred due to the ground permeation and strength properties it affords the fastener; its ready availability; and the ease and low cost with which it is applied.

In other embodiments, hook and loop fasteners can be fabricated with hot-melt binders in which agents other than water effect the cross-linking. These binders have hydrolytically stable, cross-linked bonds, as in the preferred embodiment, but require additional chemicals and/or manufacturing precautions. For example, hot-melt binders with free isocyanate groups may be cross-linked by adding polyfunctional compounds, such as polyfunctional (including bifunctional) alcohols or polyfunctional (including bifunctional) amines, to the binder just before it is applied to the ground. This results in urethane and ureido bonds, respectively.

Free radical catalysis can also be used to cause cross-linking of a hot-melt binder. The free radical catalyst may be included in the binder as the binder is manufactured, provided the melt temperature of the binder is below the activation temperature of the catalyst. Otherwise, the catalyst may be added as the binder is applied to the ground.

As yet another example, hot-melt polyester binders can be applied with a formaldehyde type cross-link agent and Carbopol ®, which yields an interpenetrating polymer network that serves the function of the cross-linking.

Figure 3A:
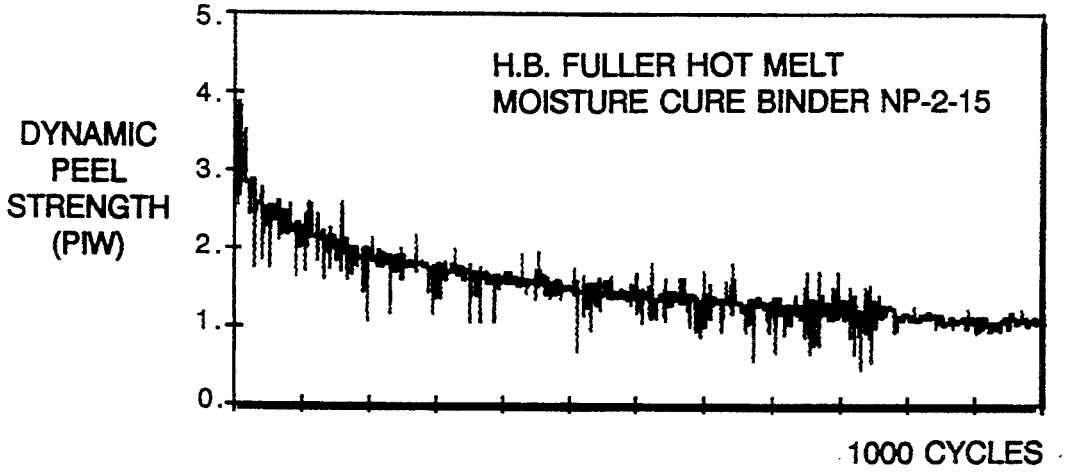
FIGS. 3A, 3B, and 3C are graphs showing dynamic peel strength degradation with open/close cycling for hook and loop fasteners made with hot-melt, moisture-curing binder; standard urethane binder; and standard acrylic binder; respectively.
Figure 3B:
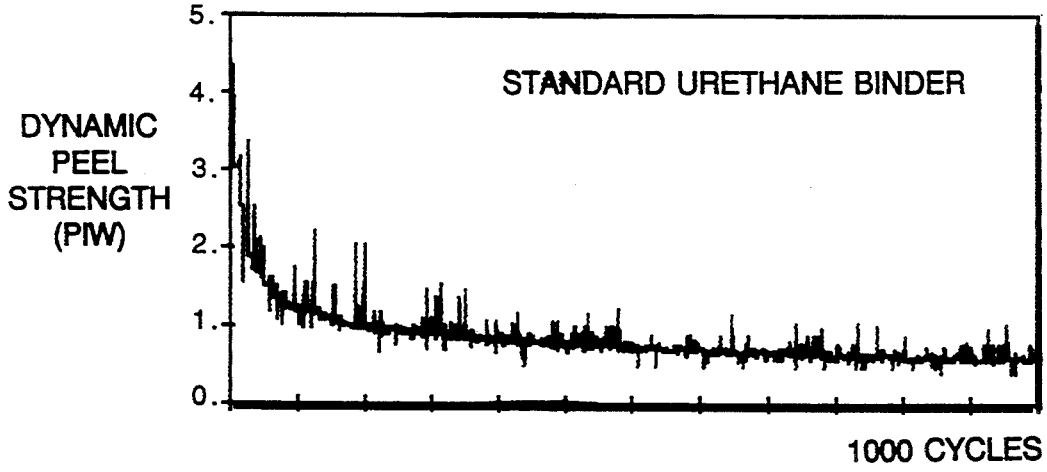
Figure 3C:
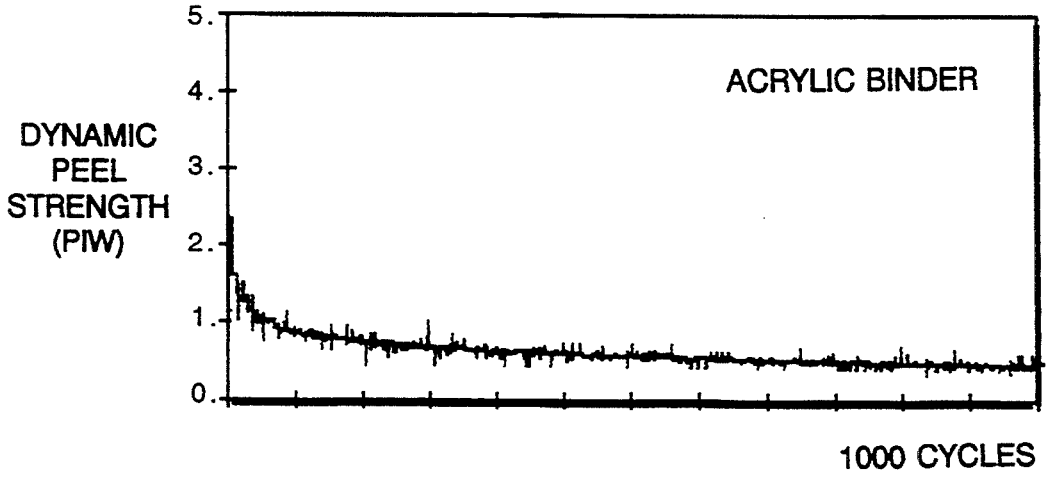

Fasteners made with thermosetting, hot-melt binders have been found to provide exceptional strength and durability. FIGS. 3A, 3B, and 3C show dynamic peel strength for fasteners fabricated with Fuller NP-2015 (moisture-curable polyurethane), standard urethane as is used in the textile or touch fastener art, and acrylic binders, respectively. Dynamic peel strength is shown as the force, in pounds per inch of fastener width (PIW), required to peel mated hook and loop sections apart. One thousand open and close cycles were run over the course of an hour. As shown in FIGS. 3A, 3B, and 3C, the peel strength of fasteners having a hot-melt, moisture-curable, urethane binder levels off at about 1.2 or 1.3 PIW, whereas the peel strength of fasteners having standard urethane or acrylic binders levels off at about 0.4 or 0.5 PIW.

Fasteners fabricated with hot-melt, moisture-curable polyurethane also possess excellent hook pull characteristics. (Hook pull is the amount of force required to pull a single hook yarn out of the bound ground sheet.) Such fasteners show good fray resistance as well. Fray resistance gives an indication as to how well the binder adheres to the ground fibers 18 and the pile elements. Fray resistance is evaluated by longitudinally slitting fastener strips every inch across their width, but not along the entire length; washing the fastener strips in a consumer type washing machine in a water/detergent solution at 140° F. for four hours; then drying the fastener strips in a consumer type dryer for forty-five minutes or until dry. The dryer exhaust stack temperature should be approximately 150° F., and the fasteners should be washed and dried with a dummy load of three to four pounds of clothes.

After drying, the fastener's fray resistance is evaluated by using a needle or finger nail to separate individual fibers 18 from the ground 16 and noting the amount of effort required to separate the fibers. This is a subjective test, and a rating from 1 (poor) to 5 (excellent) is used to describe the results.

Test data demonstrating the advantages of moisture cured, hot-melt binders is listed in Table I below.

TABLE I

| Binder | Hook Pull lbs./hook (std. dev.) | Adhesive Add-on g./51 in$^2$. | Fray Value |
|---|---|---|---|
| Bostik 10583-63 | 4.9(0.7) | 1.36 | 5 |
| Findley 3082 | 5.4(0.3) | 2.32 | 5 |
| Fuller 2015 | 4.6(0.2) | 1.83 | 5 |
| Acrylic | 3.4(0.4) | 3.93 | 3 |
| Acrylic | 3.0(0.3) | 2.20 | 4 |
| Acrylic | 2.3(0.1) | 1–1.5 | 3–5 |
| Urethane | 2.3(0.2) | 1–1.5 | 3–5 |

It has been reported that the fray resistance of fasteners with hot-melt, moisture-curable polyurethane actually improves after boiling the fastener in water. It is believed that free isocyanate groups, not sufficiently close at room temperature to react and cross-link, are affected by the higher temperature and the ready availability of moisture—both of which facilitate cross-linking —so as to enter into cross-linking reaction. This increases the number of cross-links and hence, the strength of the product. In this way the product may even improve in strength properties and fray resistance. It is believed similar improvement of a reduced but desirable effect can be obtained by laundering at normal clothes washer temperatures.

Although thermosetting, hot-melt binders are preferred, fasteners may be fabricated, in still other embodiments, with thermoplastic hot-melt binders while still obtaining some of the system and process advantages of the invention. For example, hydrocarbon polyolefin resins, ethylene vinyl acetate (EVA) resins, polyamide type resins, and polyester type resins have all been successfully applied to the ground as hot-melts. Examples of such resins include H. B. Fuller co. EVA adhesives 1669, 1828, and 8229; Atochem Co. Poly(amide) H005T; Emser Co. Poly(amide) 1P1C; and Emser Co. Poly(esters) 6P1, 8P1C, and 1264P1. Although fasteners made with thermoplastic binders tend to be not as strong nor as resistant to dry cleaning as those made with thermosetting binders, they do possess a certain degree of wash resistance and can be used, for instance, in applications not exposed to dry cleaning conditions.

As noted above, hot-melt application is the preferred method for applying the binder to the ground. Hot-melt application entails melting a resin, initially in solid form, and applying the molten resin to the ground in a controlled fashion. In a preferred system for manufacturing hook and loop fasteners with hot-melt binders, a continuous strip, or tape, of pile elements is heated to approximately the same temperature as the molten resin, and the resin is applied to the non-pile side of the tape while the tape is suspended between two support points. These two steps in the manufacturing process are essential for obtaining proper penetration of the binder into the ground and hence, maximum fastener strength performance. The coated tape is cooled and the resin is cured before further processing.

Figure 4:
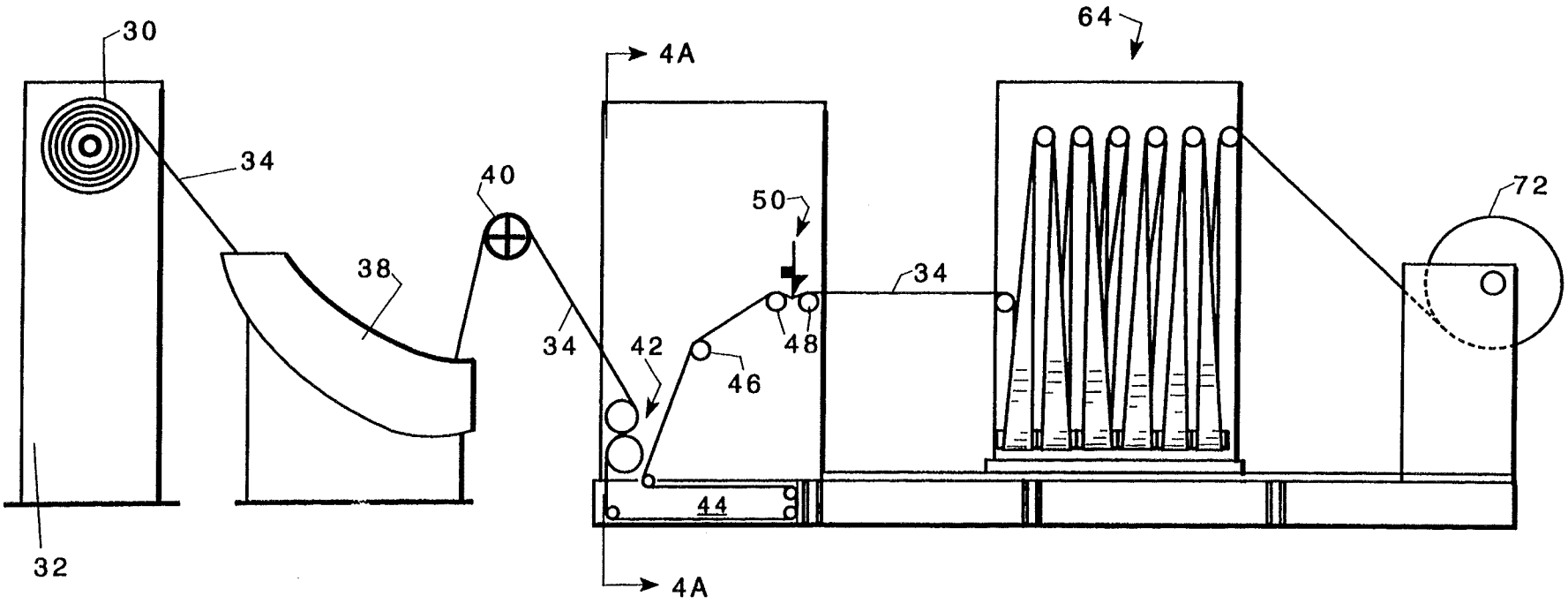
FIG. 4 is a side elevational view of a preferred embodiment of a production line used to apply hot-melt binder to a tape of hook or loop elements.

In the preferred embodiment of a hook and loop fastener tape coating system shown in FIG. 4, a large roll of tape 30 is placed on a motorized unwind device 32. The tape 34 is unwound into J-box accumulator 38 which holds a slack supply of tape. Tape 34 is withdrawn from J-box accumulator 38, as it is needed, by drive tension device 42, a powered set of nip rolls having tension and speed sensors and controllers. The tape 34 is pulled over whipper device 40 as it is withdrawn from J-box 38. Whipper device 40 is a set of paddles rotating counter to the direction of tape travel and takes out kinks which may have formed in the tape 34 as it is unwound into the J-box. From drive tension device 42, the tape passes through heater unit 44.

Figure 4A:
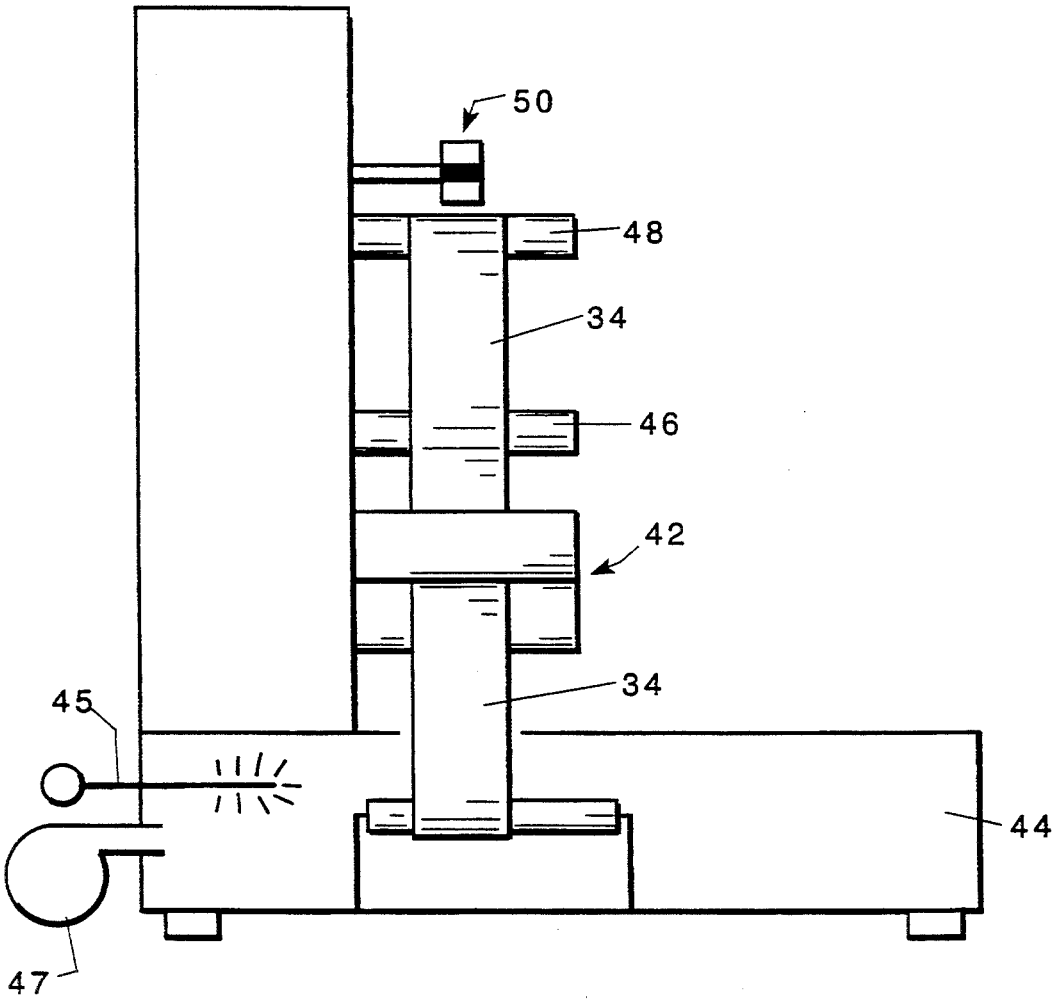
FIG. 4A is a diagramatic side view of the heater unit shown in FIG. 4, taken along line 4A—4A.

As shown in FIG. 4A, heating is accomplished in heater unit 44 by a large heat gun 45 which has its heated end inside the plenum of heater unit 44. Air heated by heat gun 45 is blown around tape 34 with blower 47. Tape 34 is pre-heated to between 225° F. and 250° F., the temperature at which the melted binder is applied to the tape. As indicated above, heating the tape is a critically important step for the preferred binder. If tape 34 is not heated, the binder will cool when it is applied to the tape by transferring heat to the tape. This cooling causes an increase in the viscosity of the binder, which retards penetration of the binder into the ground of the tape and prevents full saturation and achievement of the desired level of ultimate strength.

After being heated, tape 34 passes through a guidance system 46 so that it is properly aligned for coating with the binder. It then passes across rollers 48, with the pile side 56 facing down, and under coating head 50, which applies the binder to the tape.

Figure 5:
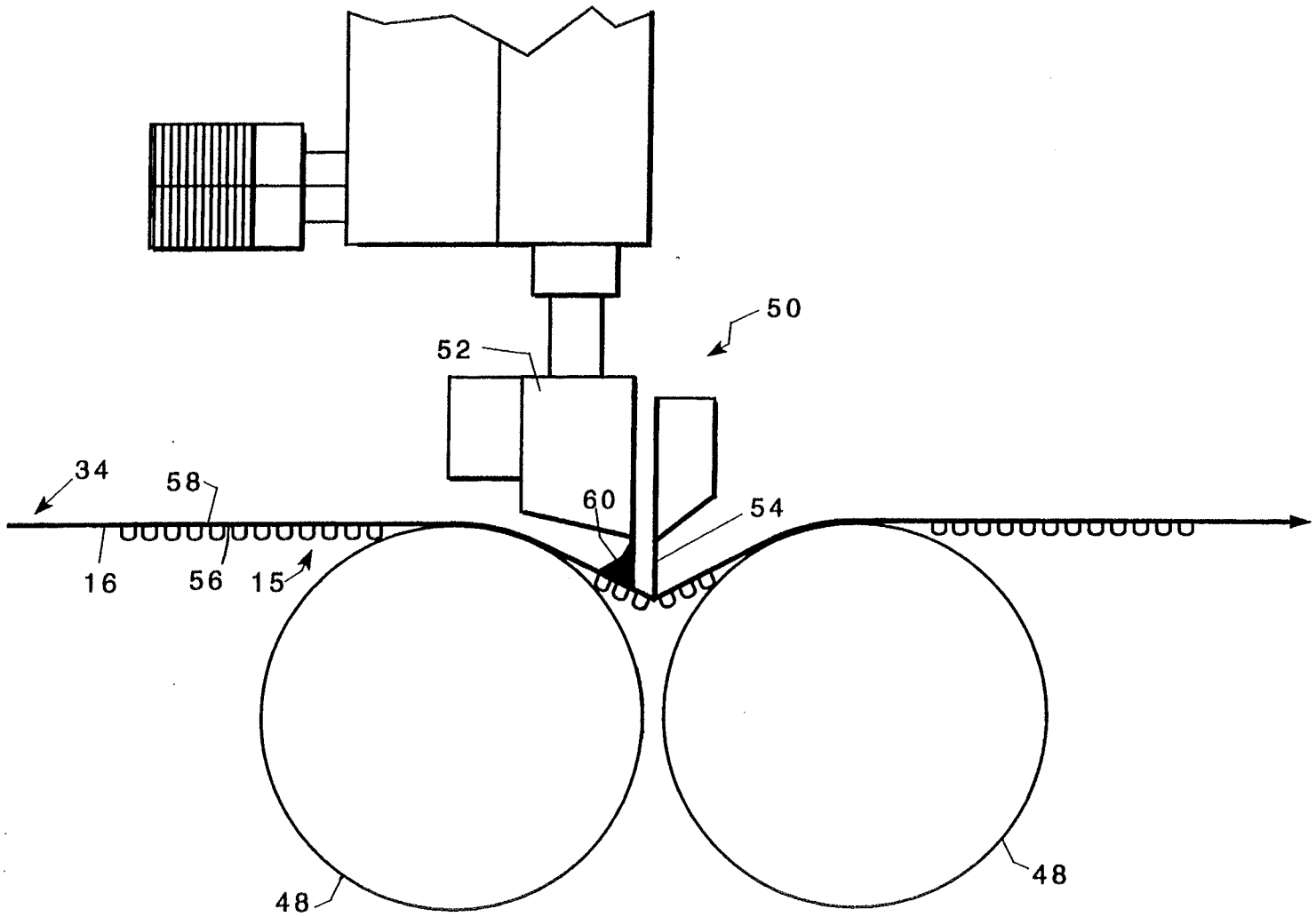
FIG. 5 is diagrammatic view of a preferred coating head and coating knife applying hot-melt binder to a tape of loop elements according to the hot-melt application method of the invention.

As shown in more detail in FIG. 5, coating head 50 comprises a slot-die coater 52 which dispenses the molten binder, and a coating knife 54 which presses the binder into ground 16. Coating head 50 should be positioned such that the binder is applied to, and the coating knife 54 contacts, the tape 34 approximately midway between rollers 48, the support points mentioned above. It is important for there to be no supporting surface under the tape at this point, as this allows coating knife 54 to be pressed against tape 34 such that tape 34 bends around the coating knife in a V-shaped fashion, which enhances permeation of the binder into the tape. It also allows for greater regulation of the pressure of coating knife 54 against tape 34. By regulating the pressure of coating knife 54 against tape 34, permeation of the binder into ground 16 may be controlled. The binder should penetrate from the non-pile side 58 to the pile side 56 of ground 16, but should not wick into the pile 15 itself.

Permeation of the binder is also controlled by controlling the rate at which binder is deposited on tape 34. A puddle of binder 60 forms on the upstream side (taken from the perspective of tape progression) of coating knife 54. If the rate of pumping from the supply is increased, a larger puddle forms, and the increased hydrostatic pressure aids permeation. The amount of binder applied may be monitored using a highly sensitive sensor (not shown), as is known in the art, located just downstream (taken from the perspective of tape progression) of the coating head.

Furthermore, the degree of permeation of binder into ground 16 is affected by the viscosity of the binder when it is applied to the tape 34: the less viscous the binder, the greater its permeation. Permeation of ground 16 without wicking into the pile 15 has been obtained with binders having viscosities in the range of about 500 to 18000 centipoise, viscosities on the order of 500 to 2000 being preferred for hot-melt, moisture-curing urethane. As the viscosity of the binder is directly affected by its temperature, controlling the binder temperature is the primary way to control the viscosity; appropriate binder temperature for the preferred binders ranges from 225° F. to 250° F.

As noted previously, the term "hot-melt" derives from the fact that the binder is originally a solid, but is melted for application. The binder is melted in a moisture proof pail melter (not shown) which has a platen in it. The platen melts just the surface of the solid material, and the liquid portion is immediately pumped out of the melter under pressure using a suitable pump. The liquified binder travels through a heated hose (not shown) and into coating head 50, which applies the binder to tape 34. Coating head 50 should be heated to maintain the desired binder temperature, viz. 225° F. to 250° F.

From the coating head, the tape 34 passes through accumulator 64, where the binder cools and loses tackiness. Cooling may be accomplished using ambient air, or accumulator 64 may be sealed and cooled air circulated through it.

As shown in FIG. 4, the upper rollers 66 and lower rollers 68 of accumulator 64 are set perpendicularly to each other. As the coated tape 34 passes back and forth from upper to lower roller, it is given a quarter twist such that the coated, non-pile side 58 does not contact the rollers 66, 68.

Curing of the binder may be accelerated by various agents. Accumulator 64 may be sealed, and a moisture and/or ammonia or ammonia-like atmosphere introduced. Alternatively, moisture and heat may be added to enhance curing. As a third alternative, an organo tin compound may be added to accelerate curing. Curing should not be accelerated too much, however, as carbon dioxide bubbles, released during the cure process, will discolor the tape if curing is done too fast.

Although use of accumulator 64 is preferred, it is not always necessary. If the coating process is conducted at a slow enough rate such that ambient cooling is sufficient, or if cure acceleration is not desired, then the tape may be wound up by windup device 70 directly. Otherwise, the tape is wound up after passing out of the accumulator.

After being wound up into a coated roll 72, the tape is allowed to stand for approximately 24 hours before being rewound onto another spool. If this rewinding is not done after about 24 hours, under certain circumstances difficulty can be encountered later in trying to unwind the tape for further processing.

Manufacturing hook and loop fasteners with hot-melt binders according to the above described method avoids the need for solvents, which are often toxic, and curing ovens. This reduces material costs as well as energy costs. Less manpower is required to run the production line, and the production line takes up less floor space than conventional production lines.

Figure 6:
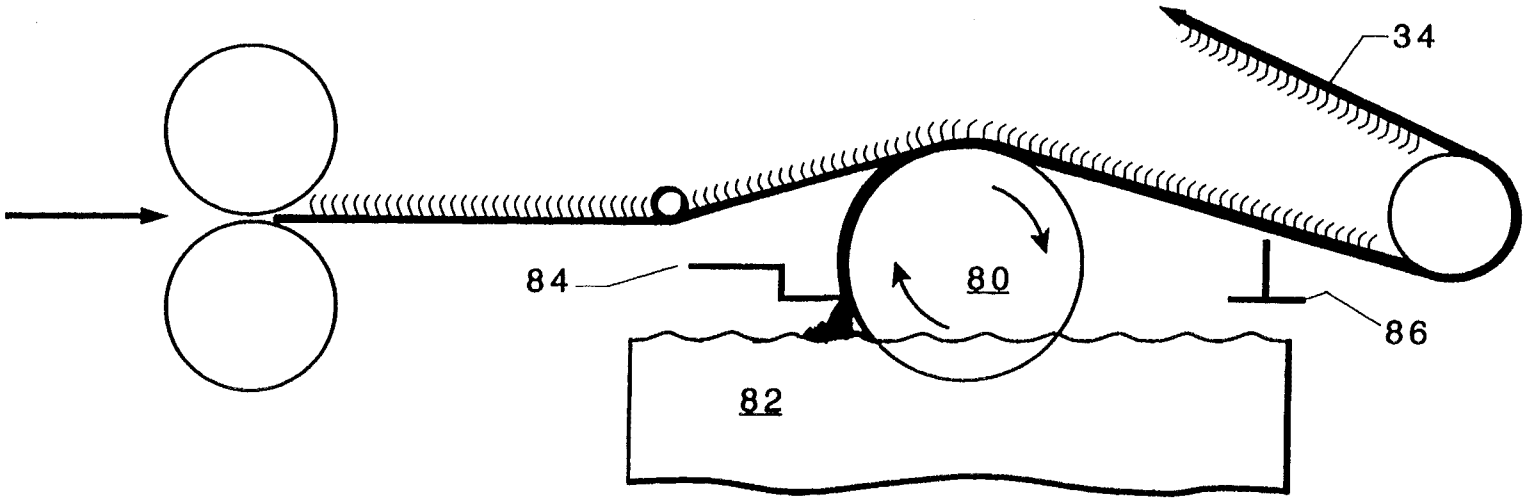
FIG. 6 is a diagrammatic view of a drum applying binder to a tape according to the reverse roll-coating method as known in the art.

Although hot-melt application is the preferred method for applying the cross-link forming binder to the ground, a satisfactory fastener may be obtained using more conventional methods. For example, moisture-curing urethane with free isocyanate groups is available in neat liquid form from Bostik, Boston St., Middleton, Mass., 01949. Such a liquid binder is applied to the ground using reverse drum roll coating, a technique in which an application drum 80 turns in a reservoir of the binder 82, as shown in FIG. 6. The top of drum 80 is above the reservoir of binder 82 and drags a coating of the binder with it as it rotates. The binder is applied to and permeates ground 16 as the ground is pulled across rotating drum 80. The amount of binder applied to the tape 34 is controlled by controlling, using horizontally adjustable metering blade 84, the amount of binder picked up by applicator drum 80. Alternatively, the amount of binder on tape 34 is regulated using vertically adjustable scraper blade 86.

If liquid moisture-curable binder is used, it is necessary to treat the binder, after it has been applied to the ground, with a cure accelerating agent. Otherwise, the tape will be too tacky to process. Tin or zinc compounds, such as tin or zinc salts of carboxylic acids, work well.

As an alternative method of application, a suitable moisture-curable binder having free isocyanate groups may be dissolved in a solvent. The solution is applied using the reverse roll coating method described above. This method necessitates the use of drying ovens to "flash off" excess solvent, which releases solvents into the atmosphere. Functionally, however, the hook and loop fastener product is equivalent in desired properties in many respects to a hot-melt, moisture-cure binder applied using the hot-melt method described above.

Reverse roll coating can also be used to apply liquid binders, having carbon-carbon double bonds, which are cross-linked by adding a photosensitizer to the binder just before the binder is applied to the ground. Cure is effected simply by exposure of the binder to suitable light. Drying ovens are therefore not needed, and the space savings and energy cost savings realized with the hot-melt application method may be realizable with a liquid application method.

EXAMPLES

The following examples demonstrate the above described binders, their respective coating techniques, and test results which have been obtained.

EXAMPLE USING FULLER NP-2015

A 500 yard roll of uncut Velcro ® hook #88, 4.25 in. wide, was placed on the unwind of the machine and coated at 225°–250° F. pail, hose, coater and tape temperatures, employing a coating knife 3.5–4 inches wide. The coating knives had a 30° chamfer along the coating edge to spread the adhesive to the edges of the tape. When coating was complete, the roll of coated tape was removed from the windup and allowed to stand for 48 hrs. The tape was conditioned at 73° F. and 50% relative humidity for 24 hrs. and tested for fray and hook pull characteristics. A 300 yard roll of 4.25 in. Velcro ® loop #001 was treated the same way as the hook above.

Use of Findley adhesive 3082 and Bostik adhesive 10538-63 gave comparable results.

Typical results are shown in Tables II and III below. (For comparison purposes, on unbound Velcro ® hook #88, hooks pull at 0.25 lbs./hk. On unbound Velcro ® hook #81, hooks pull at 0.50 lbs/hk.)

TABLE II

| Blade[1] | Tape Speed (yd/min) | Tape Tension (#) | Hook or Loop | Fray | Hook Pull (#/HK) | Adhesive | Adhesive Add-on (grams/51 in$^2$) |
|---|---|---|---|---|---|---|---|
| 4 Bump[2] | 10 | 30 | H | 4 | 4.4 | NP-2015 | 2.06 |
| 4 Bowed[3] | 10 | 30 | H | 4 | 4.1 | NP-2015 | 2.13 |
| 3 ½R[4] | 10 | 30 | H | 4 | 3.3 | NP-2015 | 1.93 |
| 3 ½R | 10 | 30 | L | 4 | — | NP-2015 | 1.36 |
| 4 Bowed | 10 | 30 | L | 4 | — | NP-2015 | 1.38 |
| 4 Bump | 10 | 30 | L | 4 | — | NP-2015 | 1.79 |
| 4 Dam | 10 | 30 | L | 5 | — | NP-2015 | 1.47 |
| 4 Dam | 10 | 30 | H | 5 | 4.1 | NP-2015 | 2.17 |
| 4 Bowed | 10 | 30 | H | 5 | 4.0 | NP-2015 | 1.96 |
| 4 Bowed | 10 | 30 | L | 5 | — | NP-2015 | 1.28 |
| 4 Dam | 10 | 30 | L | 5 | — | NP-2015 | 1.03 |
| 4 Dam | 10 | 30 | L | 5 | — | NP-2015 | 0.97 |
| 4 Dam | 10 | 30 | L | 5 | — | NP-2015 | 0.96 |
| 4 Dam | 10 | 30 | L | 5 | — | NP-2015 | 0.90 |
| 4 Dam | 10 | 30 | L | 5 | — | NP-2015 | 0.92 |
| 4 Dam | 10 | 30 | L | 5 | — | NP-2015 | 1.02 |
| 4 Dam | 10 | 30 | L | 5 | — | NP-2015 | 0.95 |
| 4 Dam | 10 | 30 | H | 5 | — | NP-2015 | 0.96 |
| 4 Dam | 10 | 30 | H | 5 | 4.5 | NP-2015 | 1.62 |
| 4 Dam | 10 | 30 | H | 5 | 4.6 | NP-2015 | 2.05 |
| 4 Dam | 10 | 30 | H | 5 | 4.5 | NP-2015 | 2.71 |
| 4 Dam | 10 | 30 | H | 5 | 4.8 | NP-2015 | 1.52 |
| 4 Dam | 10 | 30 | H | 5 | 4.4 | NP-2015 | 1.91 |
| 4 Dam | 10 | 30 | H | 5 | 5.9 | 10538-63 | 1.5 |
| 4 Dam | 10 | 30 | H | 5 | 5.5 | NP-2015 | 1.5 |
| 4 Dam | 10 | 20 | L | 5 | — | NP-2015 | 1.02 |
| 4 Dam | 10 | 20 | L | 5 | 5.3 | NP-2015 | 2.25 |
| 4 Dam | 15 | 30 | H | 5 | 6.6 | 10538-63 | 3.01 |
| 4 Dam | 15 | 30 | H | 5 | 4.3 | NP-2015 | 1.88 |
| 4 Dam | 15 | 20 | H | 5 | 4.8 | NP-2015 | 2.67 |
| 4 Dam | 10 | 30 | L | 5 | — | NP-2015 | 1.38 |

[1]Number in front is blade width.
[2]"Bump" indicates slight protuberance from edge of blade contacting tape.
[3]"Bowed" indicates blade is convex relative to surface of the tape.
[4]"R" indicates blade edge contacting tape is rounded.
[5]"Dam" indicates there is a fluid-spreader (dam) located inside the die slot which facilitates coating over entire width of tape.

EXAMPLES USING BOSTIK LIQUID MOISTURE-CURE RESINS

Uncut Velcro ® hook #88 was coated using a laboratory knife coater and Bostik liquid resins 83B, 90A, and 90C. The coating was done at ambient temperature and humidity. After coating, the tapes were allowed to stand until the coatings were hard. The tapes were then conditioned at 73° F. and 50% relative humidity before conducting hook pull and fray tests. Results are shown in Table IV below.

TABLE III

| Other Velcro ® Fasteners | | | |
|---|---|---|---|
| Color (hook[1] or loop[2]) | Adhesive | Hook Pull (#/hook) | Fray |
| Black hook | NP-2015 | 3.10 | 3–4 |
| Black loop | | | 4 |
| Blue hook | NP-2015 | 4.28 | 3–4 |
| Blue loop | | | 3–4 |
| Beige hook | NP-2015 | 4.52 | 4 |
| Beige loop | | | 5 |
| Gray hook | NP-2015 | 5.50 | 4 |
| Gray loop | | | 5 |
| Green hook | NP-2015 | 3.82 | 4 |
| Green loop | | | 3–4 |

[1]Hooks all coated using 3.5 inch wide dam blade, with 20# tape tension.
[2]Loops all coated using 3.5 inch wide radius blade, with 30# tape tension.

EXAMPLES USING THERMOPLASTIC HOT-MELT BINDERS.

(H. B. Fuller co. EVA adhesives 1669, 1828, and 8229; Atochem Co. poly(amide) H005T; Emser Co. poly(amide) 1P1C; and Eraser Co. Poly(esters) 6P1, 8P1C, and 1264P1)

Test 1 - Emser poly(esters) 8P1C, 6P1, and 1264P1; Emser Poly(amide) 1P1C; and Atochem poly(amide) H005T. Samples were coated on a Chemsultants Lab Coater at 350°–370° F., hook pulls were taken, and the samples reheated for two different lengths of time at the coating temperature. Results are shown in Table V below.

TABLE V

| Binder | Adhesive Add-on g./51 in.$^2$ | Hook Pulls, Lbs./hook (std. dev.) Off Coater | 5 min. Reheat | 20 min. Reheat |
|---|---|---|---|---|
| 8P1C | 4.08 | 1.7(0.4) | 2.7(0.7) | 3.0(0.2) |
| 6P1 | 9.64 | 2.2(0.1) | 2.7(0.2) | 3.7(0.3) |
| 1264P1 | 4.64 | 1.1(0.1) | 1.8(0.3) | 3.2(0.1) |
| 1264P1 | 10.8 | 1.0(0.1) | 2.5(0.2) | 3.1(0.4) |
| 1264P1 | 12.4 | 1.2(0.1) | 2.5(0.2) | 3.2(0.3) |
| 1P1C | 6.10 | 2.5(0.5) | 3.6(0.7) | 4.5(0.7) |
| H005T | 5.97 | 1.9(0.6) | 3.5(0.9) | 4.8(0.5) |

Test 2 - H. B. Fuller EVA Adhesives 1828, 1669, and 8229. Binders were applied on a Chemsultants Lab Coater at 350°–375° F. Results are shown in Table VI below.

TABLE VI

| Binder | Hook Pulls, #/hook (std. dev.) |
|---|---|
| 1828 | 1.4(0.1) |
| 1669 | 1.1(0.2) |
| 8229 | 1.2(0.2) |

Test 3 - Emser Poly(ester) Griltex 8P1C and Atochem Poly(amide) H005T. Binder was applied on a Chemsultants Lab coater, a knife type coater, set at 2 mils. After original application of binder, hook pulls were taken; then, the samples were reheated in an oven for 10 min. and the hook pulls repeated since penetration was,observed to be poor after the original application of the binder. Results are shown in Table VII below.

TABLE VII

| Binder | Hook pull, lbs./hook (std. dev.) Before Reheat | After Reheat | Reheat T°F. |
|---|---|---|---|
| H005T | 1.6(0.2) | 4.3(0.9) | 330–380 |
| H005T | 1.4(0.1) | 4.3(0.5) | 330–380 |
| H005T | 2.1(0.3) | 5.6(0.2) | 330–380 |
| H005T | 2.1(0.6) | 5.2(0.3) | 380–405 |
| H005T | 1.7(0.4) | 5.0(0.2) | 380–405 |
| 8P1C | 1.2(0.3) | 2.5(0.5) | 375–405 |
| 8P1C | 1.7(0.3) | 3.0(0.3) | 375–405 |

EXAMPLES USING LIGHT CURED BINDER

Uncut 4.25 in. Velcro® hook #88 was hand-coated with 15 different roll bars using Energy Sciences acrylic type liquid monomer mixtures (88291 and 88292). The different roll bars provided different adhesive add-on amounts. After coating, the tapes were exposed to the ultraviolet light of a "Fusion Systems" 300 watt/in., electrodeless mercury vapor lamp at 120 fpm. Hook pull results are shown in Table VIII below.

TABLE VIII

| Bar # | Binder | Hook Pull (#/hook) |
|---|---|---|
| 1 | 88291 | 1.34 |
| 1 | 88291 | 1.32 |
| 1 | 88291 | 1.42 |
| 1 | 88291 | 1.30 |
| 1 | 88291 | 1.31 |
| 2 | 88291 | 1.67 |
| 2 | 88291 | 1.78 |
| 2 | 88291 | 1.64 |
| 2 | 88291 | 1.39 |
| 2 | 88291 | 1.49 |

TABLE VIII-continued

| Bar # | Binder | Hook Pull (#/hook) |
|---|---|---|
| 3 | 88291 | 1.80 |
| 3 | 88291 | 1.75 |
| 3 | 88291 | 1.65 |
| 3 | 88291 | 1.42 |
| 3 | 88291 | 1.54 |
| 4 | 88291 | 1.77 |
| 4 | 88291 | 1.78 |
| 4 | 88291 | 1.75 |
| 4 | 88291 | 1.67 |
| 4 | 88291 | 1.53 |
| 5 | 88291 | 1.63 |
| 5 | 88291 | 1.62 |
| 5 | 88291 | 1.60 |
| 5 | 88291 | 1.50 |
| 5 | 88291 | 1.62 |
| 6 | 88291 | 1.62 |
| 6 | 88291 | 1.67 |
| 6 | 88291 | 1.63 |
| 6 | 88291 | 1.87 |
| 6 | 88291 | 1.91 |
| 6A | 88291 | 2.24 |
| 6A | 88291 | 2.12 |
| 6A | 88291 | 2.19 |
| 6A | 88291 | 1.67 |
| 6A | 88291 | 1.93 |
| 7 | 88291 | 1.50 |
| 7 | 88291 | 1.58 |
| 7 | 88291 | 1.50 |
| 7 | 88291 | 1.50 |
| 7 | 88291 | 1.54 |
| 8 | 88291 | 1.63 |
| 8 | 88291 | 1.47 |
| 8 | 88291 | 1.43 |
| 8 | 88291 | 1.32 |
| 8 | 88291 | 1.45 |
| 9 | 88292 | 1.42 |
| 9 | 88292 | 1.48 |
| 9 | 88292 | 1.52 |
| 9 | 88292 | 1.63 |
| 9 | 88292 | 1.52 |
| 10 | 88292 | 2.06 |
| 10 | 88292 | 2.06 |
| 10 | 88292 | 1.85 |
| 10 | 88292 | 1.78 |
| 10 | 88292 | 1.80 |
| 11 | 88292 | 1.78 |
| 11 | 88292 | 1.73 |
| 11 | 88292 | 1.87 |
| 11 | 88292 | 1.63 |
| 11 | 88292 | 1.59 |
| 12 | 88292 | 1.53 |
| 12 | 88292 | 1.49 |
| 12 | 88292 | 1.57 |
| 12 | 88292 | 1.49 |
| 12 | 88292 | 1.52 |
| 13 | 88292 | 1.40 |
| 13 | 88292 | 1.53 |
| 13 | 88292 | 1.37 |
| 13 | 88292 | 1.24 |
| 13 | 88292 | 1.29 |
| 14 | 88292 | 1.22 |
| 14 | 88292 | 1.58 |
| 14 | 88292 | 1.40 |
| 14 | 88292 | 1.52 |
| 14 | 88292 | 1.49 |

EXAMPLE USING NP-FULLER 2048 DISSOLVED IN TOLUENE

A 50:50 v/v solution of the resin in toluene was prepared. The solution was hand-coated onto a piece of uncut 4.25 in. Velcro® hook #88 using a "Doctor blade" set at 8 mils. The tape was allowed to stand for 48 hrs. during which time the solvent evaporated and the resin cured. The tape was then conditioned for 24 hrs. at 73° F. and 50% relative humidity before running fray and hook pull tests. The hook pull test results and other data are shown in Table IX below.

TABLE IX

| Sample | Hook Pull (#/hook) | Adhesive Add-on (gram/51 in$^2$) | Fray |
|---|---|---|---|
| Hook 88 | 4.50 | | |
| | 3.70 | | |
| | 4.71 | | |
| | 4.08 | | |
| | 3.50 | 3.7 | 4 |

EXAMPLE USING FREE RADICAL CATALYSIS

A formulation made up of 10 parts by weight Owens-Corning Fiberglass VS-17 thermosetting poly(ester), 0.25 parts Akzo M-50 catalyst, and 0.25 pints Akzo accelerator NL-49P. This formulated material was hand-coated onto uncut 4.25 in Velcro® hook #88 using a "doctorblade" set at 8 mils. The coated tape was then placed in an oven at room temperature and the temperature raised to 300° F. The cured tape was removed and cooled providing a bound tape.

What is claimed is:

1. A hook or loop component for use in a hook and loop fastener system comprising a ground sheet and a pile of strong filamentary construction extending from one side of the ground sheet to form the hook or loop of the component, the ground sheet comprising a textile backing impregnated with a solidified hot-melt binder of synthetic resin wherein said binder comprises the reaction product of free isocyanate groups which have entered into cross-linked bonds with an activator to effect cure of the binder.

2. The product of claim 1 wherein said binder is hydrolytically stable.

3. The product of claim 1 wherein said activator comprises moisture such that said binder comprises polyurethane-type bonds.

4. The product of claim 3 wherein said binder further comprises ureido-type cross-link bonds.

5. The product of claim 1 wherein said cross-linked bonds are ureido or urethane cross-link bonds formed by exposure of the resin to an activator comprising bifunctional or polyfunctional amine or alcohol respectively.

6. The product of claim 1 wherein said binder comprises an interpenetrating polymer network.

7. The product of claim 1 formed by the process of applying to the textile ground sheet a fluid mass of said hot-melt binder under conditions enabling substantially complete impregnation of the ground sheet without contamination of the pile by the binder.

8. The product of claim 7 formed by the process of applying said fluid mass to said ground sheet by a coater.

9. The product of claim 7 formed by the process of preheating the ground sheet prior to application of the hot-melt binder.

10. A hook or loop component for use in a hook and loop fastener system comprising a ground sheet and a pile of strong filamentary construction extending from one side of the ground sheet to form the hook or loop of the component, the ground sheet comprising a textile backing impregnated with a binder that comprises the product formed by reacting free isocyanate groups with an activator to form cross-linked bonds to effect cure of the binder, said ground sheet being substantially impregnated with said binder and said pile being substantially free of contamination by said binder.

11. The product of claim 10 resulting from the process of applying binder to said ground sheet as a neat liquid.

12. The product of claim 10 resulting from the process of applying binder to said ground sheet as a solution of binder material dissolved in a solvent.

13. The product of claim 10 resulting from the process of curing said binder with moisture.

14. The product of claim 13 wherein said binder is in a cured state resulting from the reaction of said free isocyanate groups with ambient moisture.

15. The product of claim 13 wherein said binder is in a cured state resulting from the reaction of said free isocyanate groups with moisture which has been added to the binder.

16. The product of claim 10 wherein said binder is in a cured state resulting from the addition of polyfunctional amine to the binder.

17. The product of claim 16 resulting from the process of applying said binder to the ground sheet as a hot-melt.

18. The product of claim 16 resulting from the process of applying said binder to the ground sheet as a solution.

19. The product of claim 10 wherein said binder is in a cured state resulting from the addition of polyfunctional alcohol to the binder.

20. The product of claim 19 resulting from the process of applying said binder to the ground sheet as a hot-melt.

21. The product of claim 19 resulting from the process of applying said binder to the ground sheet as a solution.

* * * * *

UNITED STATES PATENT AND TRADEMARK OFFICE

CERTIFICATE OF CORRECTION

PATENT NO. : 5,436,051

DATED : July 25, 1995

INVENTOR(S) : L. Guy Donaruma et al.

It is certified that error appears in the above-identified patent and that said Letters Patent is hereby corrected as shown below:

Cols. 9-10 Table III should be moved so that it is between Table II and "EXAMPLES USING BOSTIK LIQUID MOISTURE-CURE RESINS".

Col. 10 Line 6, please insert Table IV, below.

Bostik Liquid Moisture Cure Binder Test Hook #88

| Binder | Hook Pull (#/hook) | Adhesive Add-on (grams/51in$^2$) | Fray |
|---|---|---|---|
| 83B | 2.8 | 1.54 | 3 |
| 83B | 3.3 | 1.54 | 3 |
| 83B | 2.6 | 1.73 | 3 |
| 90A | 4.7 | 1.26 | 4 |
| 90A | 5.3 | 1.28 | 4 |
| 90A | 5.6 | 1.42 | 4 |
| 90C | 3.7 | 1.26 | 3-4 |
| 90C | 4.4 | 1.42 | 3-4 |
| 90C | 4.5 | 1.70 | 3-4 |

Table IV

UNITED STATES PATENT AND TRADEMARK OFFICE

CERTIFICATE OF CORRECTION

PATENT NO. : 5,436,051

DATED : July 25, 1995

INVENTOR(S) : L. Guy Donaruma et al.

It is certified that error appears in the above-identified patent and that said Letters Patent is hereby corrected as shown below:

Col. 10, lines 26 and 27; "poly(amide)" should be --Poly(amide)--;

Col. 10, line 27; "Eraser" should be --Emser--;

Col. 10, line 64, "poly(esters)" should be --Poly(esters)--;

Col. 10, line 65; "poly(amide) should be --Poly(amide)--;

Col. 11, line 26; insert --(Variation in the add-on did not significantly affect performance.)--

Col. 11, line 33, delete "," after "was".

Signed and Sealed this

Seventeenth Day of June, 1997

Bruce Lehman

*Attest:*

BRUCE LEHMAN

*Attesting Officer*

*Commissioner of Patents and Trademarks*